US009583076B2

(12) United States Patent
Nigro

(10) Patent No.: US 9,583,076 B2
(45) Date of Patent: Feb. 28, 2017

(54) DEVICE AND METHOD FOR IMPROVING THE SOUND OF MUSICAL INSTRUMENTS

(71) Applicant: Luciano Nigro, Catania (IT)

(72) Inventor: Luciano Nigro, Catania (IT)

( * ) Notice: Subject to any disclaimer, the term of this patent is extended or adjusted under 35 U.S.C. 154(b) by 0 days.

(21) Appl. No.: 15/159,822

(22) Filed: May 20, 2016

(65) Prior Publication Data

US 2016/0343356 A1 Nov. 24, 2016

(51) Int. Cl.
*G10D 3/00* (2006.01)
*G10H 3/22* (2006.01)

(52) U.S. Cl.
CPC ..... *G10D 3/00* (2013.01); *G10H 3/22* (2013.01)

(58) Field of Classification Search
CPC ..... G10D 3/00; G10H 3/22
See application file for complete search history.

(56) References Cited

U.S. PATENT DOCUMENTS 2,911,872 A * 11/1959 Wendel ..... G10D 3/00 84/10
4,075,921 A * 2/1978 Heet ..... G10H 3/26 84/738
4,236,433 A * 12/1980 Holland ..... G10H 3/26 84/298
4,697,491 A * 10/1987 Maloney ..... G10H 3/18 84/723
4,907,483 A * 3/1990 Rose ..... G10H 3/18 84/726
4,941,388 A * 7/1990 Hoover ..... G10H 3/26 84/726
5,031,501 A * 7/1991 Ashworth ..... G10D 3/00 84/723
5,070,759 A * 12/1991 Hoover ..... G10H 3/18 84/726
5,123,324 A * 6/1992 Rose ..... G10H 3/18 84/726
5,142,961 A * 9/1992 Paroutaud ..... G10F 1/00 84/2
5,523,526 A * 6/1996 Shattil ..... G01R 33/42 84/728
5,537,908 A * 7/1996 Rabe ..... G10D 3/00 84/312 R
5,585,588 A * 12/1996 Tumura ..... G10H 3/26 84/726
6,479,738 B1 * 11/2002 Gilmore ..... G10C 3/00 84/454

(Continued)

*Primary Examiner* — Robert W Horn
(74) *Attorney, Agent, or Firm* — PatShegen IP

(57) ABSTRACT

A device for improving the sound quality of an acoustic musical instrument made of wood provided with a plurality of metallic strings comprises a hollow casing adapted to be placed above the strings of the instrument, a generation circuit housed in the hollow casing for generating an electromagnetic field, a plurality of emitting elements hosed in the hollow casing and connected to the generation circuit to direct the electromagnetic field toward the strings of the instrument, wherein the hollow casing is provided with coupling elements to be mounted on the instrument at a predetermined distance from the strings such as to maintain the emitting elements raised from the strings to induce, without contact, independent vibration thereof by means of the electromagnetic field.

14 Claims, 3 Drawing Sheets

(56) References Cited

U.S. PATENT DOCUMENTS

| | | | | |
|---|---|---|---|---|
| 7,227,068 | B1 * | 6/2007 | Van Doren | G10D 1/005 84/297 R |
| 7,678,987 | B2 * | 3/2010 | Lye | G10D 3/00 84/294 |
| 7,968,779 | B2 * | 6/2011 | Courtright | G10D 1/005 84/320 |
| 7,977,555 | B2 * | 7/2011 | Hall | G10D 1/005 84/291 |
| 7,977,565 | B1 * | 7/2011 | Lye | G10D 1/005 84/294 |
| 8,134,064 | B2 * | 3/2012 | Sanns, Jr. | G10H 3/18 84/453 |
| 8,283,551 | B2 * | 10/2012 | Lye | G10D 1/005 84/294 |
| 8,314,322 | B2 * | 11/2012 | Langberg | G10D 3/00 84/723 |
| 8,642,877 | B1 * | 2/2014 | Blish | G10H 3/22 84/453 |
| 8,662,245 | B1 * | 3/2014 | Hall | G10D 1/005 181/198 |
| 9,305,533 | B2 * | 4/2016 | Langberg | G10D 3/00 |
| 9,412,347 | B2 * | 8/2016 | Kobayashi | G10D 3/04 |
| 2006/0117938 | A1 * | 6/2006 | Gillette | G10H 3/185 84/723 |
| 2009/0293707 | A1 * | 12/2009 | Suhr | G10D 1/005 84/723 |

* cited by examiner

DEVICE AND METHOD FOR IMPROVING THE SOUND OF MUSICAL INSTRUMENTS

TECHNICAL FIELD

The present invention relates to musical instruments and in particular it has as object a device and a method for improving the sound quality of string musical instruments made of wood, such as guitars, violins, violas, cellos, and in general for all instruments provided with a handle and a plurality of metallic strings.

STATE OF THE ART

A musical instrument, in physics, is a system adapted to generate sound waves to be propagated into the surrounding environment.

When, for example, the strings of a musical instrument are vibrated, they induce the vibration of immediately adjacent air particles and transmit this vibration remotely by elastic waves, called sound or acoustic waves. The wooden sound box of the musical instrument itself vibrates together with the strings and the vibrations produced in the air by the sound box are perceived as sound.

The expression "acoustic musical instrument" comprises any instrument which produces sounds that are amplified, in a natural way and without the use of external systems, from the sound box of the instrument itself.

In particular, the shape and structure of the acoustic musical instrument, as well as the mode used to produce sounds, contribute to the final yield of the sound, both in terms of intensity and of timber.

It is known that an acoustic musical instrument improves its performance, and specifically its sound quality, with ageing, reaching its sound maturity after years of use, due to the effect of the sound waves produced by playing it.

In particular, with the ageing, the wooden sound box vibrates better, that is, with less friction, and the air mass filters better through the sound box, thus producing a higher quality sound.

Therefore, devices and methods have been developed to make the sound box, and more generally all wooden parts of an acoustic musical instrument, age more quickly.

An example of such devices and methods is disclosed in U.S. Pat. No. 8,283,551, wherein the ageing of an acoustic musical instrument is induced by applying vibration to the strings of the instrument and, more precisely, by applying such vibrations close to the bridge. Such document shows a device comprising a frame provided with projections spaced apart by grooves and an electric vibration generator.

The case may be attached in a removable way to one or more strings of the instrument and the size of each groove between each pair of adjacent projections is sufficient to accommodate at least one, and preferably two strings when the case is placed in directed contact with the strings to allow the transfer of mechanical vibrations generated by the vibration generator.

The case is made of a material capable of effectively transmitting the vibrations from the vibrations generator to the musical instrument, preferably made of rubber, plastic, wood or metal.

The vibration generator is preferably provided with a power switch, which can be supplied by electricity network or batteries.

The vibrations may be generated by any known mechanism such as, for example, a linear vibrator, rotary or electromagnetic, and may be controlled by connecting the instrument and the vibrations generator to a control unit which regulates the vibrations generated by the vibration generator in function of the detection of the vibrations generated in the instrument while the vibration generator is operating.

In turn, the control unit may comprise a detector operatively connected to a processor connected to the vibration generator and programmed to vary the generated vibrations to achieve and maintain a pre-selected level or interval of vibrations detected by the detector.

The detector can be mounted on the instrument or attached to it or it can be placed in an external device, for example a personal computer. The processor can be placed internally to the vibration generator or it can be placed in an external device, for example a personal computer.

The above document also discloses a method for ageing a musical instrument which provides anchoring of a device to the strings of the instrument, specifically close to the bridge, which device comprising a frame and a vibrations generator as described above.

The vibration generator is operated so as to generate vibrations and transmit them to the case which, in turn, mechanically transmits them to the strings.

This solution, while addressing the technical problem of improving the sound quality of a string musical instrument to artificially causing ageing, is however not able to be adapted in a flexible way to different types of instruments.

Furthermore, it does not offer the opportunity to realistically simulate the use of the musical instrument, i.e. producing audible sounds, that is, sound waves that propagate to the sound box to speed up the seasoning.

Moreover, the device induces vibrations in the strings of the instrument by direct contact and, therefore, there is no possibility of making the strings vibrate independently of each other.

As matter if fact, the device and the method according to the abovementioned US Patent provide a fixed-size configuration, not adjustable, of the device and of the positioning thereof close to the bridge (preferably between the bridge and the hole and, anyway, always between the bridge and the handle).

Such fixed-size configuration, however, has the drawback of not allowing the use of the same device on different musical instruments (for example, guitar and violin or guitar and cello) and such a positioning, close to the bridge, also has the drawbacks of not allowing the execution of notes and arpeggios and, therefore, a realistic simulation of the use of the musical instrument with the production of audible sounds and sound waves that, propagating toward the sound box of the instrument, will speed up the seasoning thereof.

Moreover, this known device does not allow the use in a continuous manner without any time limits and, finally, putting device in direct contact with the strings and transmitting the vibration by the generator to the case and by the case to the strings in a mechanical way, do not allow the strings to vibrate independently of each other nor to produce sounds normally perceptible as when the musical instrument is played by the hands of a user.

U.S. Pat. No. 4,075,921 discloses a device adapted to be applied to string instruments, such as electric or acoustic guitars, with the purpose of producing string vibrations. In particular, the device comprises a case designed to be positioned on the strings and having one or more housings in which are inserted the coils adapted to be energized to produce an electromagnetic field to vibrate a corresponding string located below.

The case also comprises a pair of side guides in correspondence of which is in contact with further two strings of the instrument.

Consequently, this device does not allow to bring all the strings in vibration and therefore does not allow to simulate the real use of the instrument, not being therefore suitable for the forced ageing of the instrument.

SCOPE OF THE INVENTION

It is an object of the present invention to overcome the drawbacks of the devices and methods of the prior art.

In particular, it is an object of the present invention to provide a device for ageing in a forced and accelerated manner acoustic musical instruments made of wood and equipped with a handle and a plurality of metallic strings which is adaptable to different musical instruments, and which allows to perform a realistic simulation of the use of the musical instrument, also making the strings vibrate independently of each other and produce audible sounds.

Another object of this invention is to provide a method for ageing in a forced and accelerated manner acoustic musical instruments made of wood and equipped with a handle and a plurality of metallic strings that uses a device of the type indicated above. Still another object of the present invention is to make possible an accelerated and forced ageing, as well as fully automated, of acoustic musical instruments made of wood and provided with a handle and a plurality of metallic strings by using a programming interface.

These and other objects of the present invention are achieved by a device and a method incorporating the features of the annexed claims.

The present invention provides for a device adapted to force and accelerate the aging in any acoustic musical instrument made of wood with a handle and a plurality of metallic strings, thanks to the provision of coupling elements of the device on the handle which allow to mount and fix this device at a predetermined distance from the strings, also making possible to execute arpeggios so as to reproduce the real use of an instrument.

More precisely, the coupling elements are adjustable so as to be able to mount the device to any of the acoustic musical instrument made of wood, for example a guitar, a violin, a viola, a cello or the like, and secure it to the handle thereof at a predetermined distance from the strings and in a predetermined position on the handle as a function of the desired level of sound quality.

In the preferred embodiment of the present invention, the device may be operated in an automatic way thanks to the provision of a programming interface.

A further object of the present invention is providing a method for improving the sound quality of acoustic musical instruments made of wood and equipped with a handle and a plurality of metallic strings that uses a device of the type indicated above.

It is also understood that all of the appended claims form an integral part of the present description, and that each of the technical features claimed in them is possibly independent and usable autonomously with respect to other aspects of the invention. Advantageously, the present invention has the following advantages:

- applicability to the any type of acoustic musical instruments made of wood and provided with a handle and a plurality of metallic strings having different shapes and sizes;
- ability to be used continuously without time limit;
- possibility of semiautomatic or fully automatic operation;
- reduced construction and management costs;
- small encumbrance and low weight;
- high reliability.

The solution according to the present invention allows to vibrate the strings of the musical instrument as if it were actually performed and, therefore, to vibrate the sound box in wood, thus forcing and accelerating the ageing of the same instrument and, consequently, improving the sound quality.

The solution according to the present invention is preferably applied to improve the sound quality of acoustic musical instruments made of wood, such as guitars, violins, violas, cellos and the like.

Further advantageous features will become more apparent from the following description of preferred but not exclusive embodiments, provided purely by way of non-limiting example.

BRIEF DISCLOSURE OF THE DRAWINGS

L'invenzione verra descritta qui di seguito con riferimento ad esempi non limitativi, forniti a scopo esplicativo e non limitativo nei disegni annessi, in cui:

The invention will be described hereinafter with reference to non-limiting examples, which are provided for explanatory and not limiting purposes in the attached drawings, wherein.

BEST MODES OF CARRYING OUT THE INVENTION

While the invention is susceptible to various modifications and alternative embodiments, some preferred embodiments are shown in the related drawings and will be described below in detail.

It should be understood, however, that there is no intention to limit the invention to the specific illustrated embodiments, but, on the contrary, the invention intends to cover all modifications, alternative constructions, and equivalents as fall within the scope of protection the invention as defined in the appended claims.

Figure 1:
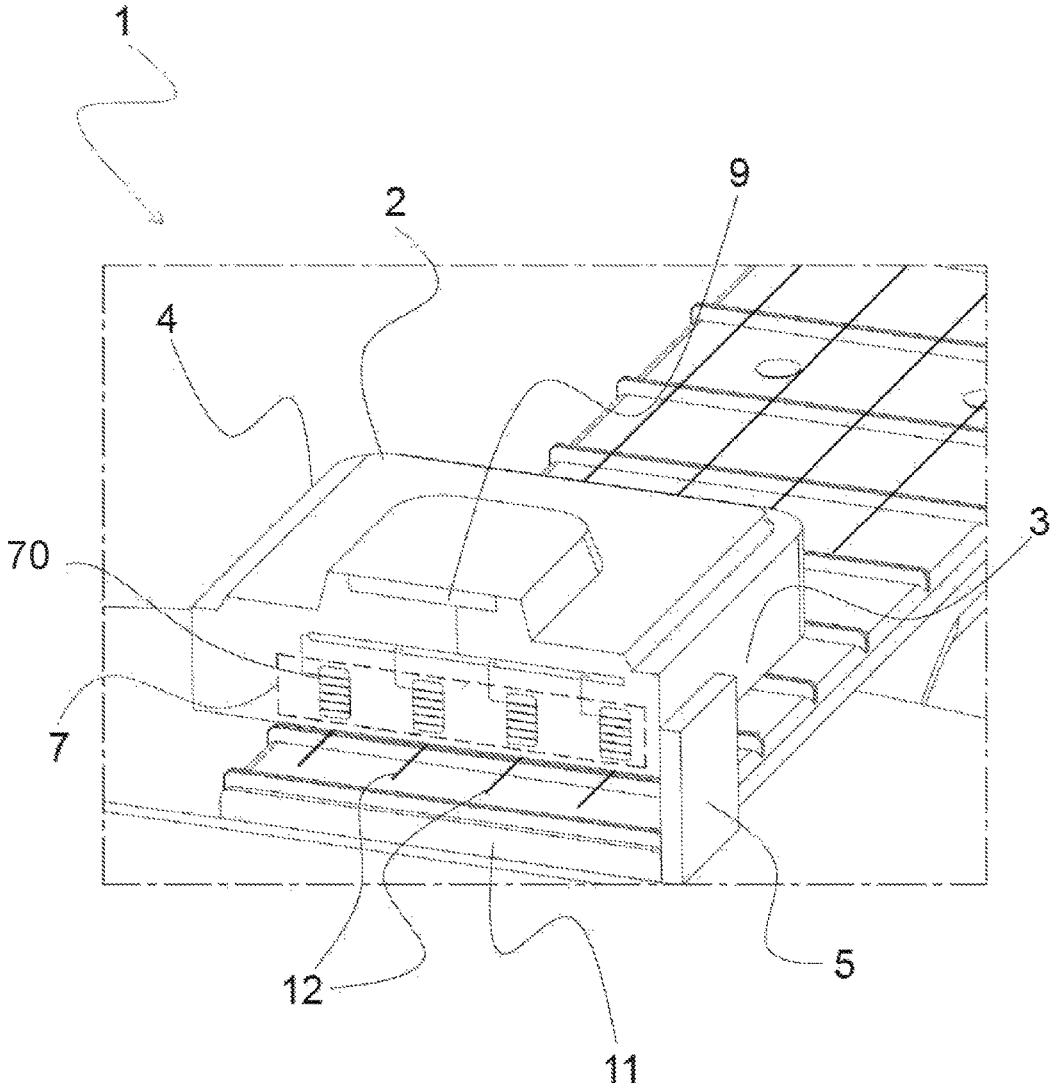
FIG. 1 is a schematic representation of a first preferred embodiment of the device of the invention.
Figure 2:
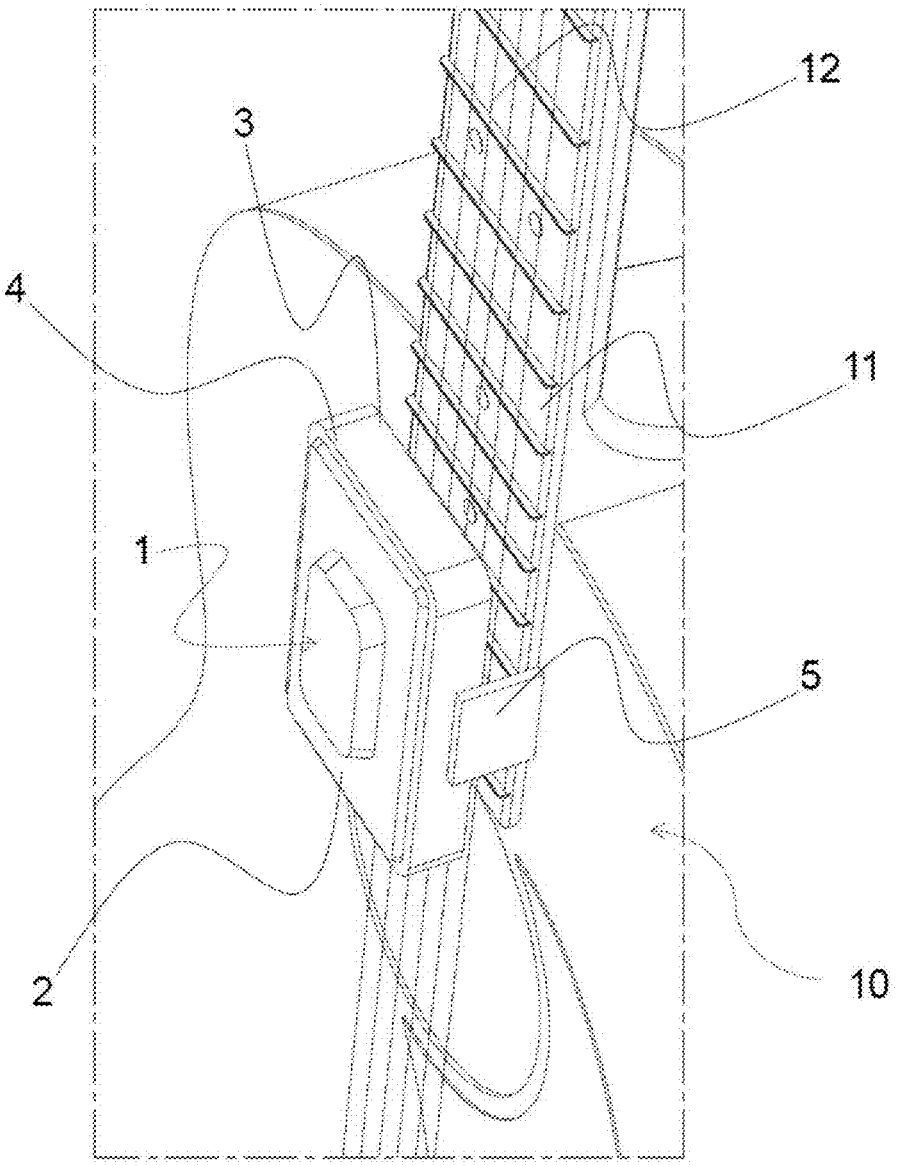
FIG. 2 shows a second embodiment of the device of the invention.

FIGS. 1 and 2 shows a device 1 for improving the sound quality of an acoustic musical instrument 10 made of wood with a handle 11 and a plurality of metallic strings 12. The device 1 comprises a hollow casing 2 formed by a base 3 and a lid 4 joined to each other in a removable manner.

A generating circuit 7 is arranged inside the casing 2 to generate an electromagnetic field and a control unit 8 to control the generating circuit 7.

The hollow casing 2 is provided with coupling elements 5 for mounting the device 1 on the handle 11 of the musical instrument 10, while maintaining the hollow casing 2 at a predetermined distance from the strings 12.

The coupling elements 5 are adjustable in length to vary the distance to which the device 1 is mounted with respect to the handle 11 of the musical instrument 10, so as to vary, accordingly, the distance between the hollow casing 2 and the strings 12.

Preferably, the coupling elements 5 are adjustable in length due to their telescopic configuration, but alternative constructive solutions may be provided, which should make the coupling elements 5 adjustable.

The length of the coupling elements 5 may be adjusted between minimum and maximum values depending on the type of musical instrument 10 which the device 1 is mounted on.

Different adjustable lengths of the coupling elements 5 may be provided so as to mount the device 1 on different musical instruments such as a guitar, a violin, a viola, a cello or the like.

The device 1 is never in direct contact with the strings 12 and the vibrations are induced in the strings not mechanically, but for the effect of the electromagnetic field generated by the generating circuit 7.

The device 1 is preferably made of plastic material, suitable to contain the generating circuit 7 which generates electromagnetic fields outside the device 1.

E'evidente, tuttavia, the possono essere ugualmente utilizzati altri materiali adatti allo scopo.

It is also clear, however, that other materials suitable for the purpose may be used. The coupling elements 5 may also be made of plastic material or in different materials always suitable to allow the fitting of the device 1 on the handle 11 of the musical instrument 10.

The base 3 and the lid 4 that make up the hollow casing 2 of the device 1 are mutually joined by means of joints or screws or other known joining means, so as to be separated from each other for any maintenance operations of the circuit 7 and/or of the control unit 8.

In the shown embodiments, the base 3 and the cover 4 have a substantially parallelepiped shape, but may have any shape, for example square, round or oval, depending on the specific requirements.

The circuit 7 comprises a plurality of emitting elements 70 to induce, without contact, independent vibrations in the strings 12 of the musical instrument 10, so that the musical instrument 10 sounds, preferably in a continuous manner, simulating the manual use, forcing and accelerating ageing and, consequently, improving the sound quality.

By "simulating manual use" it is intended that the strings 12 of the musical instrument 10 vibrate and make actual and audible sounds, similar to the sounds of a musical instrument played from the hands of a user.

As matter of fact the device 1 according to the present invention, as it is never placed in direct contact with the strings 12, allows that the latter freely vibrate and, therefore, emit defined and distinguishable sounds, corresponding to the natural tone of each string which is made to play.

It is also considered appropriate to point out that, in this description, the term "ageing" has the meaning of seasoning for acoustic purposes.

The device according to the present invention, in fact, by freely vibrating the strings 12 of the musical instrument 10 through a magnetic field, induces vibration also in the soundboard of the latter exactly as when a user plays really, obtaining the effect of a use of several years in a few days.

It is evident that the strings 12, in order to be put into vibration by the emitting elements 70, are made of metallic material, preferably steel, optionally coated, for example made of nickel-plated steel, nickel or its alloys, bronze, silver or gold, and of any known type.

For example, the strings 12 may be wound with round section wire ("round wound") or wrapped with a flat section wire ("flat wound") or wrapped with a wire having a semi-round cross-section or semi-flat section, depending on the curvature of each coil section ("ground wound").

Once mounted on the handle 11 of the musical instrument 10, if the device 1 is located closer to the strings 12, the emitting elements 70 will be able to induce vibrations of greater intensity, while if the device 1 is located farther away from the strings 12, the emitting elements 70 will induce vibration with less intensity.

In any case the distance of the device 1 from the strings 12 will never be null, because the device 1 will never be in direct contact with the strings 12.

Moreover, in any case the distance of the device 1 from the strings 12 may never be higher than the value at which the emitters elements 70 induce in the strings 12 vibrations of minimum intensity, this value obviously depending on the type of musical instrument 10 on which the device 1 is mounted.

As mentioned above, the emitting elements 70 are able to induce, without contact, independent vibrations in the strings 12 of the instrument 10.

In a first embodiment of the device 1, shown in FIG. 1, the emitting elements 70 are four, so that the device 1 is suitable for a musical instrument 10 with four strings 12, such as a violin, a viola or cello.

In FIG. 2 is shown the device 1 mounted on a guitar 10 having six strings 12, and therefore in this second embodiment the device 1 comprises six emitting elements 70. Although the shown embodiments have four or six emitting elements 70, the device 1 may comprise a different number of emitting elements 70, for example a minimum of three for a balalaika or seven for a Russian or Brazilian guitar and, in general, any number of emitting elements 70 able to vibrate independently each string 12 of a musical instrument 10.

Generally, the device 1 comprises a number of emitting elements 70 equal to the number of strings 12 of the instrument 10 to which it is applicable so that each emitting element 70 faces a corresponding string 12 without that there are strings 12 in direct contact with emitting elements 70 or other parts of the device 1.

Preferably, the emitting elements 70 are magnets with coil elements which can be controlled by the control unit 8. In detail, the control unit 8 independently controls the passage of an electric current in the coils of the magnets 70 so as to create magnetic fields that produce an attraction on the stings 12.

By controlling the flow of current in the different coils, the control unit 8 draws or releases each of the stings 12 making it vibrate.

The control unit 8 is programmed to control the emitting elements 70 according to predetermined sequences so as to vibrate the strings 12 of the musical instrument 10 according a predetermined order, possibly performing musical arpeggios by vibrating one or more strings simultaneously.

In particular, the control unit 8 is programmed to activate and deactivate emitting elements 70 in an alternating fashion, by vibrating one or more strings 12 at a time and, consequently, by executing predetermined sequences of notes and arpeggios.

Preferably, the control unit 8 is programmed so as to operate the emitting elements 70 for at least 100 hours and, preferably, with no time limit.

In one embodiment, the device 1 may further comprise a programming interface 9 operatively connected to the control unit 8 and adapted to receive programming data by a user.

In this way the user may select one of multiple programs of ageing of the musical instrument that correspond to different sequences of vibrations of the strings 12 for more or less long times.

Preferably, the programming interface 9 is a USB port adapted to receive data transmitted from an external user terminal.

However, this interface may also be a touch screen or a keypad suitably placed on the hollow casing 2 that allows the user to select predefined programs or set operating parameters of device such as the duration of the musical instrument ageing program. Preferably, the programming interface 9 is adapted to transmit to the control unit 8 a plurality of predetermined different sequences of notes and arpeggios, so as to play the instrument 10 as if it were played by a user.

Figure 3:
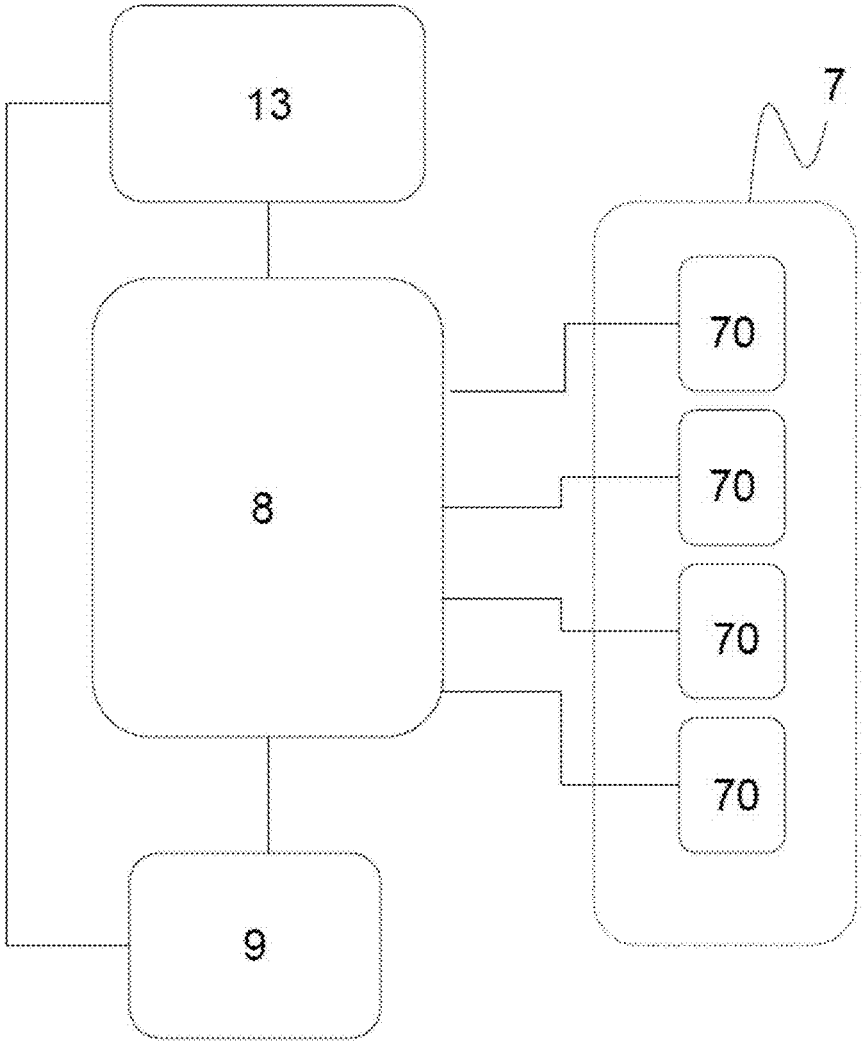
FIG. 3 is a block diagram of the device of FIG. 1.

With reference to FIG. 3, it can be observed that the plurality of emitting elements 70 is operatively connected to the control unit 8, in turn operatively connected to the programming interface 9.

A power supply system 13, for example a battery or a connection to the electricity net, is also provided for powering both the control unit 8 and the programming interface 9.

A method for improving the sound quality of an acoustic musical instrument made of wood 10 with a handle 11 and a plurality of metallic strings 12 provides a step of providing an acoustic musical instrument 10 made of wood, equipped with a handle 11 and a plurality of metallic strings 12, for improving the sound quality thereof, a step of providing a device 1 comprising a hollow casing 2 and emitting elements 70 to generate electromagnetic fields acts adapted to make the strings 12 of the musical instrument 10 vibrate.

Subsequently, the device 1 is mounted on the handle 11 of the musical instrument 10 by means of the coupling elements 5, by maintaining the hollow casing 2 to a predetermined distance from the strings 12.

The emitting elements 70 are suitably controlled to induce, without contact, independent vibrations in the strings 12 of the musical instrument 10 for a predetermined period of time, so that the musical instrument sounds 10, preferably in a continuous manner, simulating the manual use by emitting audible sounds, that is, sound waves that propagate toward the soundboard of the instrument, forcing and accelerating ageing thereof and, consequently, improving the sound quality.

The emitting elements 70 are also adapted to end the string vibrations, so that the musical instrument 10 stops playing as it reaches the desired level of sound quality. Preferably, the emitting elements 70 are controlled so as to operate continuously for at least 100 hours and, more preferably, without time limits.

Preferably, the emitting elements 70 are controlled so that, when the device 1 is mounted on the handle 11 of the musical instrument 10, corresponding predetermined sequences of notes and arpeggios are performed.

Preferably, the acoustic musical instrument 10 made of wood is a guitar, a violin, a viola, a cello or the like, wherein the device 1 is mounted and fixed at a predetermined distance from the strings 12 and in a predetermined position on the handle 11 as a function the desired level of sound quality.

The device 1 is mounted on the handle 11 of the musical instrument 10 so as to be at a distance from the strings 12 such as to allow the latter to be influenced by the electromagnetic field generated by the emitting elements 70.

In any case, the device 1 will never be placed in direct contact with the strings 12 of the instrument 10.

Preferably, the device 1 is operated for a predetermined time period greater than or equal to 100 hours and, more preferably, in a continuous way and with no time limit. From above it is clear that the device and the method described reach the intended purposes.

In particular, the disclosed device and method are adaptable to different musical instruments, they provide a possibility of operation in a continuous manner without any time limit and allow to vibrate the strings of the musical instrument as if it were really played by a user and, therefore, to vibrate the sound box in wood, thus forcing and accelerating ageing of the instrument itself and, consequently, improving the sound quality.

It is also evident, to a technician in the field, that it is possible make changes and variants to the solution disclosed with reference to the attached figures, without thereby departing from the teaching of the present invention and the scope of protection as defined by the appended claims.

The invention claimed is:

1. A device for improving the sound quality of an acoustic musical instrument made of wood provided with a plurality of metallic strings, comprising:

a hollow casing adapted to be placed above the strings of the instrument;

a generation circuit housed in the hollow casing for generating an electromagnetic field;

a plurality of emitting elements hosed in the hollow casing and connected to the generation circuit to direct the electromagnetic field toward the strings of the instrument;

wherein the hollow casing is provided with coupling elements to be mounted on the instrument at a predetermined distance from the strings such as to maintain the emitting elements raised from the strings to induce, without contact, independent vibration thereof by means of the electromagnetic field.

2. The device of claim 1, wherein the emitting elements are magnets with coil.

3. The device of claim 2, wherein the number of emitting elements is at least equal to three.

4. The device of claim 1, wherein the coupling elements are adjustable in length to vary the distance to which the hollow casing is mounted with respect to the strings of the musical instrument.

5. The device of claim 4, wherein the coupling elements are telescopic.

6. The device of claim 1, further comprising a control unit connected to the generation circuit for controlling the emission of the electromagnetic field for executing musical arpeggios.

7. The device of claim 6, further comprising a programming interface operatively connected to the control unit and adapted to receive programming data by a user.

8. The device of claim 7, wherein the programming interface is a USB port adapted to receive data transmitted from an external user terminal.

9. The device of claim 1, wherein the hollow casing comprises a base provided of the coupling elements and a lid joined to the base in a removable manner.

10. A musical instrument comprising:

a wooden sound box having a handle and a plurality of metallic strings which extend on the sound box along the handle;

a vibration device for vibrating the strings, removably mounted on the sound box;

wherein the vibration device comprises a hollow casing adapted to be placed above the strings of the instrument and housing thereinside a generation circuit for generating an electromagnetic field and a plurality of emitting elements connected to the generation circuit to direct the electromagnetic field toward the strings of the instrument;

wherein the hollow casing is provided with coupling elements to be mounted on the sound box at a predetermined distance from the strings such as to maintain the emitting elements raised from the strings to induce, without contact, independent vibration thereof by means of the electromagnetic field.

11. The musical instrument of claim 10, wherein the number of emitting elements is equal to the number of strings, each emitting element facing a respective string and being kept at a distance therefrom.

12. A method for improving the sound quality of an acoustic musical instrument made of wood with a plurality of metallic strings, comprising the following steps:

a) providing an acoustic musical instrument made of wood with a plurality of metallic strings;

b) providing a device comprising a hollow casing and emitting elements adapted to generate a plurality of electromagnetic fields adapted to bring into vibration the strings of the musical instrument;

c) mounting the device on the musical instrument by means of coupling elements, while maintaining the hollow casing at a predetermined distance from the strings;

d) controlling the emitting elements to induce, without contact, independent vibrations in the strings of the musical instrument for a predetermined period of time.

13. The method of claim 12, wherein the acoustic musical instrument made of wood is a guitar, a violin, a viola, a cello, and wherein the emitting elements are controlled so that, when the device is placed in different predetermined positions on the handle of the musical instrument, corresponding predetermined sequences of notes and arpeggios are performed.

14. The method of claim 12, wherein the predetermined period of time is equal to or greater than 100 hours.

* * * * *